US008021049B2

(12) United States Patent
Smith

(10) Patent No.: US 8,021,049 B2
(45) Date of Patent: Sep. 20, 2011

(54) BAG OF A HEAT-SHRINKABLE GAS-BARRIER THERMOPLASTIC FILM

(75) Inventor: Adrian Maxwell William Smith, Ballarat (AU)

(73) Assignee: Cryovac, Inc., Duncan, SC (US)

( * ) Notice: Subject to any disclaimer, the term of this patent is extended or adjusted under 35 U.S.C. 154(b) by 235 days.

(21) Appl. No.: 12/460,435

(22) Filed: Jul. 17, 2009
(Under 37 CFR 1.47)

(65) Prior Publication Data

US 2010/0140127 A1 Jun. 10, 2010

(51) Int. Cl.
*B65D 33/00* (2006.01)

(52) U.S. Cl. ..... 383/200; 229/87.05

(58) Field of Classification Search ..... 206/484, 206/466, 469, 532; 229/87.05, 307, 313, 229/316; 383/200, 207, 209
See application file for complete search history.

(56) References Cited

U.S. PATENT DOCUMENTS

| | | | | |
|---|---|---|---|---|
| 2,245,738 | A | 6/1941 | Taylor | 383/200 X |
| 3,354,795 | A | 11/1967 | Kugler | 383/9 X |
| 3,397,835 | A * | 8/1968 | Henning | 383/208 |
| 3,516,537 | A | 6/1970 | Dreyfus et al. | 206/46 |
| 3,554,435 | A | 1/1971 | Martinez | 383/9 |
| 3,578,239 | A | 5/1971 | Periman | 229/53 |
| 3,615,711 | A | 10/1971 | Markus et al. | 383/200 X |
| 3,663,239 | A | 5/1972 | Rowe et al. | 383/200 X |
| 4,555,025 | A | 11/1985 | Weinberg et al. | 206/497 |
| 4,576,283 | A | 3/1986 | Fafournoux | 206/574.8 |
| 4,764,028 | A | 8/1988 | Wood et al. | 206/497 |
| 5,060,803 | A * | 10/1991 | Beer et al. | 383/200 |
| 5,222,813 | A * | 6/1993 | Kopp et al. | 383/200 |
| 5,493,845 | A | 2/1996 | Adolf et al. | 53/410 |
| 6,174,083 | B1 * | 1/2001 | Delefortrie et al. | 383/200 |
| 6,260,705 | B1 | 7/2001 | Montepiani et al. | 206/497 |
| 6,499,598 | B2 | 12/2002 | Montepiani et al. | 206/497 |
| 6,790,468 | B1 | 9/2004 | Mize et al. | 426/129 |
| 2007/0177828 | A1 * | 8/2007 | Takada et al. | 383/200 |
| 2008/0063324 | A1 * | 3/2008 | Bernard et al. | 383/200 |
| 2009/0116768 | A1 * | 5/2009 | Huerta et al. | 383/207 |

FOREIGN PATENT DOCUMENTS

| | | | |
|---|---|---|---|
| EP | 0 078 761 | A2 | 5/1983 |
| EP | 0 372 886 | A2 | 6/1990 |
| EP | 0 745 539 | A1 | 4/1996 |
| FR | 2.009.866 | | 2/1970 |
| JP | 40-4339767 | | 11/1992 |
| JP | 05254551 | A * | 10/1993 |
| JP | 05319442 | A * | 12/1993 |
| JP | 06122471 | A * | 5/1994 |
| NL | 6900418 | | 7/1970 |

* cited by examiner

*Primary Examiner* — David T Fidei
(74) *Attorney, Agent, or Firm* — Rupert B. Hurley Jr.

(57) ABSTRACT

A bag of a heat shrinkable, gas-barrier thermoplastic film for packaging an item comprises a first seal adjacent a bottom edge and connecting first and second side edges, and defining an area between it, the side edges and a top edge for receiving the item, a second seal along the bottom edge or between the bottom edge and the first seal and connecting the side edges, and having a shaped portion adjacent a corner of the bag at the first side edge and the bottom edge which projects towards the top edge, and a precut extending from the bottom edge towards an apex of the shaped portion, the first seal extending from the second side edge towards the shaped portion at a level below the apex and around the shaped portion to the first side edge, and a manually graspable tab being formed between the first side edge, the first and second seals adjacent the first side edge and the shaped portion.

19 Claims, 2 Drawing Sheets

BAG OF A HEAT-SHRINKABLE GAS-BARRIER THERMOPLASTIC FILM

TECHNICAL FIELD

The invention relates to a bag of a heat shrinkable gas-barrier, thermoplastic film for packaging one or a plurality of items and to a package comprising the bag and one or more items sealed in the bag.

The invention particularly relates to an easy openable bag for vacuum shrink packaging. The bag may be made from seamless tubular film or flat film that is folded and joined, for example at one side to form a side seal. Alternatively, it may be in the form of a pouch formed from two separate pieces of film that are joined together with side seals.

BACKGROUND ART

One of the packaging methods that is in common practice today is vacuum shrink packaging, according to which an article of interest is wrapped with a heat-shrinkable thermoplastic film in the form of a bag and the package is vacuumised, heat sealed and cut off along the edge portions. The obtained package is heat shrunk to provide a tight appearance. Heat shrink packaging has gained increased popularity because it adds to the aesthetic appeal of the packaged articles, thereby enhancing their commercial value, and because it permits easy packaging of articles even if they have complex shapes.

On the other hand, packages overwrapped in heat-shrinking film have the disadvantage that the film sticks so closely to the underlying surfaces and are in such tension that they are difficult to tear when the package must be opened.

Various methods have so far been proposed with a view to overcoming this problem and facilitating the opening of packages that are made of heat shrunk films. These include: i) forming a line of perforations in a specified portion of a heat shrinkable film so that the package can be opened by tearing along the line; ii) making a U-shaped hole in a specified site on the film and attaching a paper seal over the hole to form a seal label that serves as an aid in opening the package; and iii) additionally attaching a so-called "opening tape".

However, these conventional methods have their own limitations. In the first approach, if the perforations overlie the contents of the package the perforations will grow in size upon heat treatment of the heat shrinkable film so that contaminants can potentially get into the package through the holes, thereby reducing the commercial value of the contents. In some cases, the perforations may rupture during handling. The second approach needs a special apparatus for making the U-shaped hole and, furthermore, the use of paper seals adds to the production cost. In any event, these two methods are not suited to vacuum packages, since an opening in a portion of the bag overlying the packaged item or items will lead to leakage of the vacuum. The third approach has the inherent disadvantage of being cumbersome.

An alternative arrangement for opening a shrink wrap bag is described in U.S. Pat. No. 3,516,537. In this proposal, an end seal of the bag is formed at a position remote from the bag edge to provide a tab and a tear notch is formed in the tab. A problem with this arrangement is that the tab shrinks at the same rate as the remainder of the bag when the film is shrunk around the contents, for example by at least 50%, and may therefore require a large portion of the pre-shrunk film material or be too small to readily grasp after shrinking Another easy opening system for heat shrunk bags is disclosed in EP-A-0745539 where a heat shrinkable film wrap for a food product has an edge zone isolated from the remainder by a seal between opposed film layers, and a cut extending inwardly in the zone from one edge to form a tongue when heat-shrunk to facilitate opening. The film is wrapped around the product, heat sealed peripherally and then heat-shrunk. The zone is preferably separate from and adjacent to the package closure heat seal, and may be heat-sealed peripherally or over its entire area. The film may be in the form of a bag for packaging the product under vacuum, or allow packaging under a modified atmosphere.

This system has the disadvantage that, when shrunk, the protruding tongue may not be visible or may have an unpleasant appearance and may be difficult to grip.

An improved system for opening heat shrinkable, gas-barrier thermoplastic film is described in the related U.S. Pat. Nos. 6,260,705 and 6,499,598. In this proposal, a large tear tab is formed between a closed end of a bag and a first seal extending across the bag at a location remote from the closed end. A second, shaped seal is formed from the closed end of the bag and a pre-cut is provided in the film portion between the closed end of the bag and the second seal, midway along the closed end, to facilitate tearing. The portion of the tear tab between the first seal, the closed end and the second seal is airtight. The airtight portion may contain a gas such as air such that it balloons upon heat treatment, which is said to create two pillow shaped hems having a better packaging appearance. It is also suggested that the gas present in the airtight area may reduce the shrinkage of the thermoplastic film in that area.

A problem with the proposals in these U.S. patents is the substantial volume of film material that is taken up by the tear tab, and the associated cost. The large tear tab may also be considered to detract from the appearance of the heat-shrunk package and needs to be gripped by two hands to tear it.

SUMMARY OF THE INVENTION

According to a first aspect of the present invention there is provided a bag of a heat-shrinkable, gas-barrier thermoplastic film for packaging at least one item, the bag comprising:

a) a bottom edge;

b) first and second side edges;

c) an open mouth;

d) a first seal disposed adjacent the bottom edge and connecting the first and second side edges, said first seal defining an area between it, the first and second side edges and the open mouth for receiving the at least one item to be packaged;

e) a second seal disposed substantially along the bottom edge or between the bottom edge and the first seal and connecting the first and second side edges, the second seal having a shaped portion adjacent a corner of the bag defined by one of the first and second side edges and the bottom edge which projects towards the open mouth, said shaped portion having an apex closest to the open mouth;

f) a pre-cut formed in the thermoplastic film and extending from the bottom edge towards the apex of said shaped portion of the second seal;

wherein the first seal extends from the other of the first and second side edges across the bag towards said shaped portion of the second seal at a spacing from the bottom edge less than the spacing of said apex from the bottom edge and around said shaped portion of the second seal to said one of the first and second side edges, and wherein a manually graspable tab is formed in an area of the thermoplastic film delimited by the one of the first and second side edges, the first and second seals adjacent said one of the first and second side edges and said shaped portion of the second seal.

Also according to the first aspect of the present invention, there is provided a package comprising a bag substantially as described in the immediately preceding paragraph that contains at least one item in said area and has been closed by sealing the open mouth and heat shrunk around the item(s) to closely conform to the at least one item in said area. In this aspect, the bag is preformed.

According to a second aspect of the invention, there is provided a package comprising a bag of a heat shrinkable, gas-barrier thermoplastic film and at least one item packaged in the bag, the bag comprising:

a) a bottom edge;

b) first and second side edges;

c) a closed top edge;

d) a first seal disposed adjacent the bottom edge and connecting the first and second side edges, said first seal defining a volume within the bag between it, the first and second side edges and the closed top edge in which the at least one item is received;

e) a second seal disposed substantially along the bottom edge or between the bottom edge and the first seal and connecting the first and second side edges, the second seal having a shaped portion adjacent a corner of the bag defined by one of the first and second side edges and the bottom edge which projects towards the closed top edge, said shaped portion having an apex closest to the closed top edge;

f) a precut formed in the thermoplastic film and extending from the bottom edge towards the apex of said shaped portion of the second seal;

wherein the first seal extends from the other of the first and second side edges across the bag towards said shaped portion of the second seal at a spacing from the bottom edge less than the spacing of said apex from the bottom edge and around said shaped portion of the second seal to said one of the first and second side edges, and wherein a manually graspable tab is formed in an area of the thermoplastic film delimited by the one of the first and second side edges, the first and second seals adjacent said one of the first and second side edges and said shaped portion of the second seal.

In this aspect, the bag need not be preformed. Instead, such a package may be formed by a form-fill process and machine. After formation around the at least one item, the bag may be heat shrunk around the item(s) to closely conform to the at least one item.

By the present invention, the manually graspable tab may be formed in a bottom corner of the bag, which in a bag with a bottom edge that extends perpendicularly along substantially its entire length to the first and second side edges is often otherwise excess material. This permits the parts of the first and second seals other than in that corner to be formed very close to the bottom edge, thereby minimising the material of the bag that does not form part of the area for receiving the at least one item. Additionally, since the space between the first and second seals is closed, any air or other gas contained in the space when the seals are formed will be compressed during heat shrinking and may thereby reduce the amount of heat shrink of the film material between the seals, particularly of the manually graspable tab.

In order to minimise wastage of the film material, the first seal, except where it extends around the shaped portion of the second seal, should extend as close as possible to the bottom edge of the bag while still permitting the second seal to be formed separately. In one embodiment of the unshrunk bag, except at the part that extends around the shaped portion of the second seal, the first seal extends at a spacing of no more than about 2 cm from the bottom edge and linearly across the bag. Advantageously, said spacing is in the range of about 7 to about 13 mm, for example about 10 mm.

Except at its shaped portion, the second seal may extend along the bottom edge, but in one embodiment it extends between the bottom edge and the first seal. For example, the second seal may extend from the other of the first and second side edges across the bag towards the shaped portion at a spacing of about midway between the bottom edge and the first seal, that is at from about 25 to about 75% of the aforementioned spacing.

Adjacent to said one of the first and second side edges, the first and second seals must be spaced in order to define the tab between them, that edge and the shaped portion of the second seal. The distance from the bottom edge of the end of the first seal at said one of the first and second side edges may be about the same as the distance of the apex of the shaped portion of the second seal from the bottom edge, with the first seal curving around the apex of the shaped portion of the second seal. In one embodiment, that distance of the first seal is no more than ± about 50% of the distance of the apex of the shaped portion from the bottom edge, preferably ± about 30%. In the unshrunk bag, the distance of the first seal from the bottom edge at said one of the first and second side edges may be in the range of about 50 to about 100 mm, more preferably between about 60 and about 80 mm. The first seal may meet said one of the first and second side edges substantially perpendicularly thereto, for example between 80° and 100° thereto, or at an acute or obtuse angle thereto outside this range.

In another embodiment, the first seal extends in a substantially straight line from adjacent the bottom edge, past the apex of the shaped portion of the second seal to said one of the first and second side edges. In this case the spacing from the bottom edge may be from about 1.5 to about 3 times the height of the apex, for example from about 60 mm up to about 200 mm.

Between the shaped portion and said one of the first and second side edges, the second seal should be as close as possible to the bottom edge in order to maximise the spacing of the first and second seals in the tab portion of the bag. In the unshrunk bag that part of the second seal is preferably at a distance of from 0 to about 1 cm, more preferably up to about 7 mm, for example about 5 mm, from the bottom edge. In one embodiment, the spacing of the second seal from the bottom edge between the shaped portion of the second seal and said one of the first and second side edges is substantially the same, that is within about 10%, as the spacing of the second seal from the bottom edge between said other of the first and second side edges and the shaped portion of the second seal.

The shaped portion of the second seal may be generally U- or V-shaped. The height of the shaped portion of the second seal at the apex is partly a function of the minimum size of the tab desirable after shrinking the bag. It is also a function of the desire to minimise excess material in the bag, and in one embodiment of the unshrunk bag the height of the shaped portion of the second seal at the apex is in the range of about 30 to 80 mm from the bottom edge, advantageously in the range of about 40 to 60 mm. The first seal should extend around or past the shaped portion as close as possible to the apex, also to minimise excess material in the bag, with the minimum spacing being defined by the ability to keep the first and second seals separate. In one embodiment of the unshrunk bag, that minimum spacing is no more than about 5 mm, for example about 3 to 4 mm.

The spacing of the shaped portion from said one of the first and second side edges is also a function of the minimum post-shrink tab size and the desire to minimise excess material. Preferably, that spacing in the unshrunk bag is no more than about 120 mm, for example in the range of about 30 to 100 mm, most preferably in the range of about 30 to 50 mm.

The spacing of the shaped portion of the second seal from said one of the first and second side edges may also be a function of the overall width of the bag since the bag will be opened by either holding the package with one hand or placing one hand on the package on a secure surface and opening the package by gripping the tab with the other hand and pulling. Advantageously, therefore, the shaped portion of the second seal is spaced by no more than about 35% of the width of the bag from said one of the first and second side edges. Unshrunk bag widths may be in the range of, for example, 200 to 450 mm.

Post-shrink, the tab must have a sufficient area to be able to conveniently grasp it, and in one embodiment the minimum post-shrink size of the tab is arranged at about 20 mm×20 mm. Advantageously, the minimum post-shrink tab size is arranged at about 30 mm×30 mm. The amount of hot water shrink of the thermoplastic film is partly a function of the film material, but also whether or not air or other gas is entrapped between the first and second seals. However, allowing for the thermoplastic film to reduce in area by about 50% when it is subject to heat shrinking, the tab in the unshrunk bag desirably has a size in the range of about 40 mm×40 mm to about 60 mm×60 mm. The two dimensions may vary oppositely (±) by about 50%, or be irregular, but the overall size of the tab in the post-shrink package should be sufficient to permit gripping it between a thumb and finger.

The pre-cut extends beneath the apex of the shaped portion of the second seal from the bottom edge towards the apex. The pre-cut may be a notch in the bottom edge, but in one embodiment it comprises a line of perforations which advantageously extends close to the apex, for example within about 5 mm. The line of perforations may terminate in an opening through the film material close to the apex. Optionally, it may terminate in a notch at the bottom edge. The line of perforations may extend substantially parallel to said one of the first and second side edges of the bag, but in one embodiment the line of perforations is inclined relative to that side edge from the bottom edge towards the centre of the bag. For example, the inclination may be at an angle in the range of about 10 to about 30°, such as about 20°, to that side edge. That part of the second seal which forms the side of the shaped portion closest to said one of the first and second side edges may also be inclined away from that side edge, for example at about the same angle (within about 5°) as the line of perforations.

BRIEF DESCRIPTION OF THE DRAWINGS

One embodiment of a bag of a heat-shrinkable, gas-barrier thermoplastic film and in accordance with the invention will now be described by way of example only, with reference to the accompanying drawings, in which.

DETAILED DESCRIPTION OF THE PREFERRED EMBODIMENTS

Figure 1:
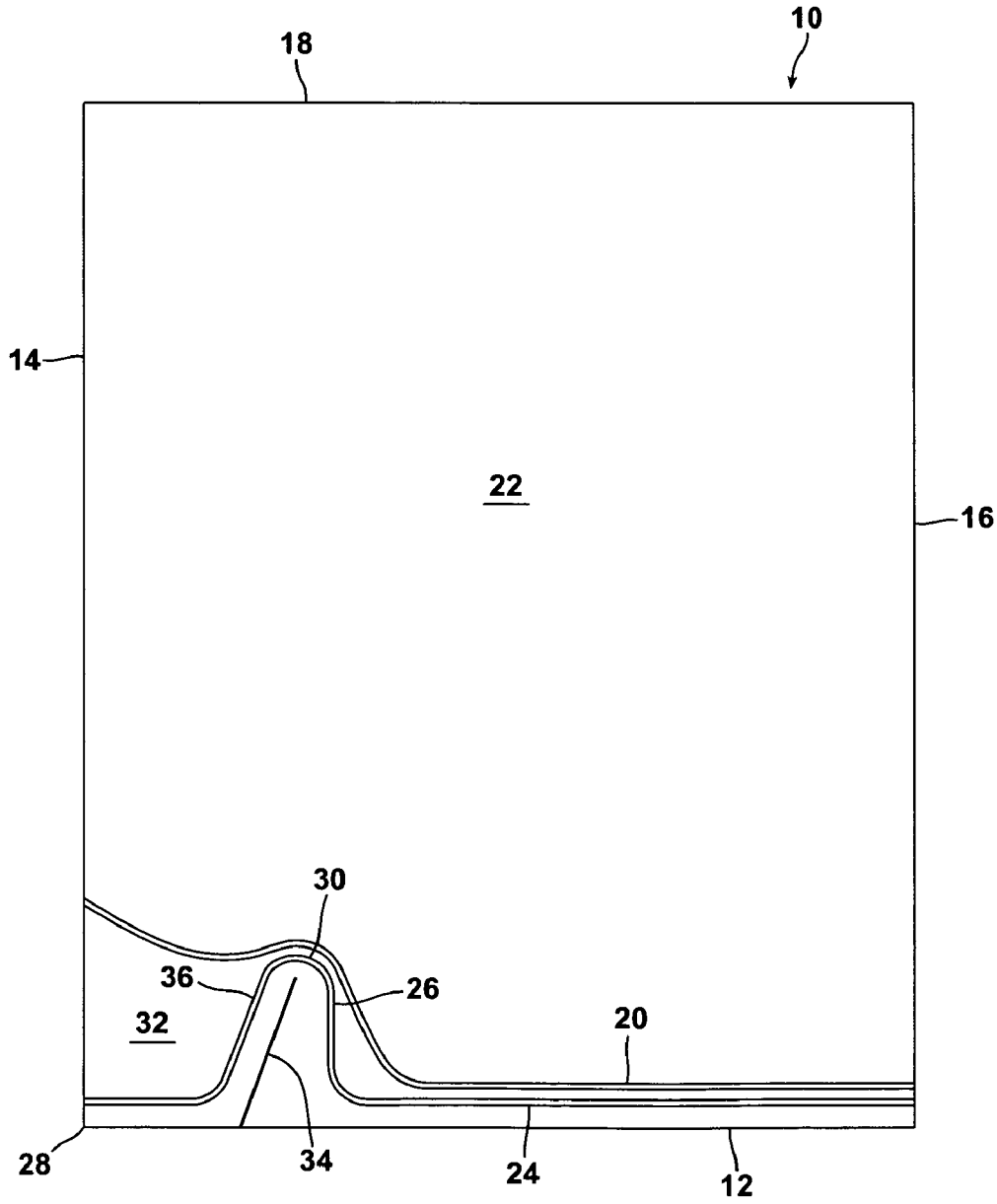
FIG. 1 is a plan view of the empty, unshrunk bag.

Referring to FIG. 1, a bag 10 of a heat shrinkable gas-barrier, thermoplastic film for packaging one or a plurality of items is provided, the bag comprising a bottom edge 12, two side edges 14 and 16 and an open mouth 18 for the introduction of the item or items to be packaged between opposed film portions.

The bottom of the bag is closed by a first heat seal 20 adjacent the bottom edge 12 connecting the two side edges 14 and 16. The first seal 20 defines with the open mouth 18 and the side edges 14 and 16 an area 22 of the bag for receiving the item or items to be packaged via the open mouth.

A second heat seal 24 connects the side edges 14 and 16 between the bottom edge 12 and the first seal 20. The majority of the second seal 24 extends at least substantially parallel to the bottom edge 12, but the second seal has a shaped portion 26 adjacent a corner 28 of the bag defined by the bottom edge 12 and the side edge 14. The shaped portion 26 projects towards the open mouth and has an apex 30 closest to the open mouth 18. The apex 30 is rounded and the portion 26 is generally U- or V-shaped. The shaped portion 26 is spaced slightly from the side edge 14 to define a tab area 32 between it and the side edge. Between the shaped portion 26 and the side edge 14, the second seal 24 extends at about the same spacing from the bottom edge as between the side edge 16 and the shaped portion 26.

A line of perforations 34 extends from the bottom edge 12 beneath the shaped portion 26 towards the apex 30 thereof as a tear initiator. The line of perforations is inclined from the bottom edge 12 towards the centre of the bag, at an angle of about 20° relative to the side edge 14. The inclination of the line of perforations 34 helps to ensure that a tear initiated there propagates towards the centre of the bag rather than towards the adjacent side edge 14.

The part 36 of the shaped portion 26 of the second seal closest to the adjacent side edge 14 is inclined at approximately the same angle to enlarge the tab area 32 slightly.

The first seal 20 follows the second seal 24 closely from the side edge 16 to the apex 30 of the shaped portion of the second seal, but spaced a few millimetres, such as 2 to 5 mm, therefrom. Accordingly, the first seal is curved around the apex 30. From adjacent the apex 30 of the shaped portion of the second seal, the first seal gradually veers away from the bottom edge 12 as it extends towards the side edge 14. This diverging of the first and second seals also relatively increases the size of the tab area 32 while only taking up a portion of the bag that would not otherwise usually be filled by the packaged item or items. In a variation, not shown, the first seal 20 extends perpendicularly from adjacent the apex 30 to the side edge 14. The area of the bag between the first and second seals 20 and 24 is gas tight since the seals extend to the closed side edges. A pocket is therefore formed between the opposed film portions of the bag which may contain air. Any such air may be compressed slightly during heat shrinking of the bag material around the packaged item or items, helping to resist shrinkage of the tab area 32 and other portions of the film material between the seals and inflating those portions. Inflating the tab area 32, in addition to resisting shrinkage, may help the user to identify and grasp the tab area.

In the embodiment illustrated in FIG. 1, the first seal 20 is about 10 mm from the bottom edge along most of its length, from the side edge 16 to adjacent the shaped portion 26 of the second seal, and the second seal 24 extends about midway between the bottom edge 12 and this part of the first seal. The shaped portion 26 of the second seal is about 40 mm wide closest to the bottom edge 12 and narrows slightly towards the apex 30. The apex 30 is about 60 mm from the bottom edge, and the line of perforations 34 extends from the bottom edge to within a few millimetres of this.

The first seal meets the side edge 14 at about 70 mm from the bottom edge 12 and the shaped portion 26 ranges between about 40 and 60 mm from the side edge 14, leaving a tab area 32 averaging about 50 mm×50 mm.

Assuming the entire bag reduces in size by 50% on heat shrinking, the tab area 32 will have average dimensions of about 25 mm×about 25 mm, the shaped portion 26 will be about 25 mm high, and the portions of the first and second seals 20 and 24 extending from there to the side edge 16 will be within 5 mm or less of the bottom edge 12.

The bag 10 is only heat shrunk once the item or items to be packaged have been placed inside it and the open mouth 18 heat sealed or otherwise closed following withdrawal of any gas in the bag area 22.

Figure 2:
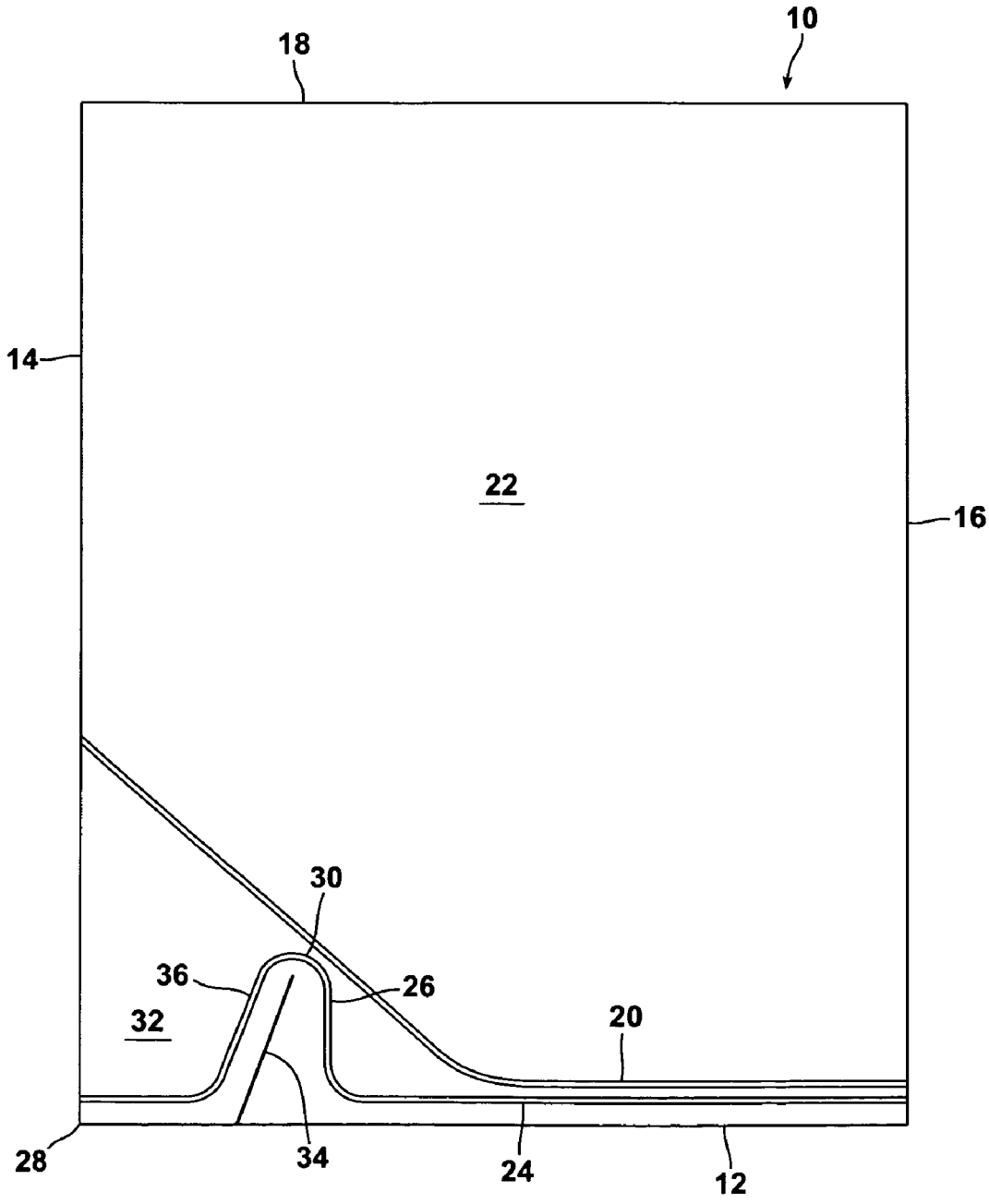
FIG. 2 shows a modification of the embodiment of FIG. 1.

In a variation illustrated in FIG. 2, the first seal 20 extends in a straight line from adjacent the side of the shaped portion 26, past the apex 30 of the shaped portion, also within a few millimetres, to the side edge 14. In this embodiment, the first seal 20 meets the side edge 14 at a distance from the bottom edge of about twice the height of the apex 30 from the bottom edge. In this embodiment, the tab portion may be longer but still using a part of this bag that is not usually occupied by the packaged item(s). The second seal 24 may be identical to that illustrated in FIG. 1, but as shown the shaped portion 26 is shorter than that in FIG. 1 (reduced distance from the bottom edge 12) and spaced slightly further from the side edge 14 in order to increase the area of the tab area 32. The line of perforations 34 is correspondingly spaced from the side edge 14.

Other features of the bag and bag material will now be described in general terms.

Definitions

As used herein, the term "homopolymer" is used with reference to a polymer resulting from the polymerization of a single monomer, i.e., a polymer consisting essentially of a single type of repeating unit.

As used herein, the term "copolymer" refers to polymers formed by the polymerization reaction of at least two different monomers.

As used herein, the term "polymer" refers to both homopolymers and co-polymers as defined above.

As used herein, the phrase "barrier layer", is used with reference to the ability of a film layer to substantially reduce the film permeability to gases such as oxygen and carbon dioxide. Typically, barrier layers comprise a barrier resin such as PVDC or EVOH.

As used herein the term "heat-shrinkable" refers to films showing a % total free shrink in the L+T (longitudinal+transverse) directions of at least 10% when heated, unrestrained, at a temperature of 85° C. in accordance with ASTM D 2732.

While the invention has been described in connection with one preferred embodiment, and a modification thereto, it will be understood that the invention is not so limited. On the contrary, the invention includes all alternatives, modifications, and equivalents as may be encompassed within the scope of the appended claims.

The film used is a mono- or bi-axially oriented, heat shrinkable film.

In general terms, mono- or bi-axially oriented heat-shrinkable films are typically made by extruding or coextruding polymers from a melt into a thick film, followed by a quick quenching to prevent or delay crystallization and by orientation of the thick film by stretching it, either mono-axially or bi-axially, under temperature conditions where molecular orientation of the film occurs and the film does not tear. Upon subsequent re-heating at a temperature close to the orientation temperature, the stretched film will tend to shrink in seeking to recover its original dimensional state.

For use in the present invention, bi-axially oriented heat-shrinkable films are preferably obtained by extruding or co-extruding the polymer(s) through a round die giving a tubular thick film called "tape", which is immediately and quickly quenched by means of a water bath or cascade, typically to about room temperature. The quenched tape is then heated to an orientation temperature and subjected to solid state orientation by stretching biaxially, while at this temperature, e.g. by the so-called "trapped bubble" technique that uses internal gas pressure to expand the diameter of the tape to form a large "bubble" and advancing the expanded tube at a faster rate than the extrusion rate so as to obtain transverse and machine (longitudinal) directions of orientation respectively. Usually the stretch is at least about 3 times in each direction. The film is then cooled and rolled up in the cooled state so as to retain the property of heat-shrinkability. The orientation temperature range generally depends on the type of polymers employed. The orientation temperature used for the manufacture of heat-shrinkable films is in any case at or above the Vicat softening point and lower than the melting temperature of at least one polymer present in the film.

Alternatively, mono- or bi-axially oriented heat-shrinkable films can be obtained by extruding the polymers through a flat die in the form of a sheet, and after a quenching step, heating the sheet to the orientation temperature and stretching it. Longitudinal orientation is generally obtained by running the sheet over at least two series of pull rolls wherein the second set runs at a higher speed than the first one. Cross-wise or transversal orientation is generally done in a tenter frame where the edges of the sheet are grasped by clips carried by two continuous chains running on two tracks that move wider apart as they go along. When bi-axially oriented films are desired, as an alternative to sequential stretching, i.e. either longitudinal first and then transversal or vice-versa, the stretching may be simultaneous in both directions. The stretched film is then cooled and rolled up as usual. Also in the case of orientation by a tenter frame, the stretch is usually at least about 3 times in each direction, but higher ratios are also common.

The films used will typically be made of a multilayer structure comprising a gas barrier layer, such as for instance a layer comprising PVDC, EVOH, a poly- or co-polyamide, etc. as known in this field. Other layers may clearly be present in order to provide the structure with the thickness and the mechanical properties required. One particular film structure envisaged for use in the present invention, manufactured and marketed under the Trade Mark OMNI™ by Cryovac Australia, of Fawkner, Victoria, Australia, is as follows:

| Layer number, from the outside | Layer Function | Layer Material | Layer Thickness |
|---|---|---|---|
| 1 | Abuse Layer | Ethylene/vinyl acetate (EVA) | 13 μm |
| 2 | Barrier Layer | Polyvinylidene chloride (PVDC) | 4.5 μm |
| 3 | Core, Puncture Resistant Layer | EVA (70 wt %)/ VLDPE (30 wt %) | 24.5 μm |
| 4 | Sealing Layer | LLDPE (70 wt %)/ VLDPE (30 wt %) | 6.5 μm |

Other film structures and layer materials are described in for example U.S. Pat. No. 6,790,468, the contents of which are hereby incorporated by reference.

Those skilled in the art will understand that bags according to the invention can be formed from other films and can have various shapes with rounded, straight or irregular edges; one or more of these is typically heat sealed. Bags normally include one or two factory sealed edges, and one or two folded edges. One edge, the open mouth of the bag adapted to receive an article, is heat sealed after loading the article into the bag.

The end-seal bags 10 of FIGS. 1 and 2 are made from a seamless tubing extruded from an annular die, as described above. The length of the end-seal bag runs in the machine direction, i.e., the direction in which the annular extrudate is made, with the lay-flat width of the end-seal bags corresponding with the lay-flat width of the seamless tubing. The end seal bags 10 in lay-flat configuration have side edges 14 and 16 formed by creased edges of the tubing. The open top 18 and bottom edge 12 of the end-seal bags are made by transverse cuts across the tubing. Heat seals 20 and 24 are made across the tubing, with the inward first seal 20 forming the bottom closure of the end-seal bags. Heat sealing can be carried out using an impulse sealing apparatus, as known to those of skill in the art. As a continuous tubing is converted into a plurality of end-seal bags by cutting and sealing, the resulting bags can be placed and aligned on a conveyor belt by a mechanical and pneumatic device. Optionally, the bags can be imbricated in shingled format with one or more adhesive tapes being applied to the bags so that the bags are easily manipulated and opened for use. An article to be packaged is thereafter placed in the bag, which is then vacuumised, sealed and heat shrunk to complete a tight package.

Bags according to the present invention may also be made as they are filled by using horizontal form fill machines. Such packages are made from a heat shrinkable gas-barrier, thermoplastic film for packaging one or a plurality of items, shaped into a tube by a longitudinal seal while at the same time the article to be packed is inserted into this tube. Thereafter the tube is closed at its two ends by two hermetic transverse heat seals. At one end the transverse heat seal will comprise the first and second seals in accordance with the invention. The closed bags are vacuumised prior to heat shrinking.

These systems are per se conventional and well known in the art. Other methods of making bags from multilayer films are described in the aforementioned U.S. Pat. No. 6,790,468 (in which the reference to patches may be disregarded for the purposes of the present invention).

Shrink bags according to the present invention may be also printed or coloured.

In a particular embodiment shrink bags according to the present invention may also have printed or drawn arrows or drawings to indicate how to open the package.

In a particular embodiment of the present invention any air entrapped between the transverse first and second seals 14 and 16 is at atmospheric pressure until the bag is heat shrunk around the one or more items in the package. Alternatively, air or other gas could be introduced under pressure, for example as the seals are formed.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The invention claimed is:

1. A bag of a heat shrinkable, gas-barrier thermoplastic film for packaging at least one item, the bag comprising:

a) a bottom edge;

b) first and second side edges;

c) an open mouth;

d) a first seal disposed adjacent the bottom edge and connecting the first and second side edges, said first seal defining an area between it, the first and second side edges and the open mouth for receiving the at least one item to be packaged;

e) a second seal disposed substantially along the bottom edge or between the bottom edge and the first seal and connecting the first and second side edges, the second seal having a shaped portion adjacent a corner of the bag defined by one of the first and second side edges and the bottom edge which projects towards the open mouth, said shaped portion having an apex closest to the open mouth;

f) a precut formed in the thermoplastic film and extending from the bottom edge towards the apex of said shaped portion of the second seal;

wherein the first seal extends from the other of the first and second side edges across the bag towards said shaped portion of the second seal at a spacing from the bottom edge less than the spacing of said apex from the bottom edge and around said shaped portion of the second seal to said one of the first and second side edges, and wherein a manually graspable tab is formed in an area of the thermoplastic film delimited by the one of the first and second side edges, the first and second seals adjacent said one of the first and second side edges and said shaped portion of the second seal.

2. A bag according to claim 1, wherein the first seal extends from the other of the first and second side edges across the bag towards the shaped portion of the second seal at a spacing in the unshrunk bag of no more than about 2 cm from the bottom edge.

3. A bag according to claim 1, wherein the first seal extends linearly across the bag from the other of the first and second side edges towards the shaped portion of the second seal.

4. A bag according to claim 1, wherein the part of the first seal that extends around the shaped portion of the second seal is curved.

5. A bag according to claim 4, wherein the first seal meets said one of the first and second side edges at a spacing from the bottom edge of no more than ±50% of the distance of the apex of the shaped portion of the second seal from the bottom edge.

6. A bag according to claim 5, wherein in the unshrunk bag, the first seal meets said one of the first and second side edges at a spacing of from about 50 to about 100 mm from the bottom edge.

7. A bag according to claim 1, wherein the part of the first seal that extends around the shaped portion of the second seal is linear.

8. A bag according to claim 7, wherein the first seal meets said one of the first and second side edges at a spacing from the bottom edge of about 1.5 to about 3 times the distance of the apex of the shaped portion of the second seal from the bottom edge.

9. A bag according to claim 8, wherein in the unshrunk bag, the first seal meets said one of the first and second side edges at a spacing of from about 60 mm to about 200 mm from the bottom edge.

10. A bag according to claim 1, wherein the second seal extends from the other of the first and second side edges across the bag towards the shaped portion of the second seal at a spacing of from about 25 to about 75% of the spacing of the first seal from the bottom edge.

11. A bag according to claim 1, wherein in the unshrunk bag the second seal between the shaped portion and the one of the first and second side edges at a distance of from 0 to about 1 cm from the bottom edge.

12. A bag according to claim 1, wherein in the unshrunk bag the spacing of the shaped portion from said one of the first and second side edges is no more than about 120 mm.

13. A bag according to claim 1, wherein in the unshrunk bag the height of the shaped portion of the second seal at the apex is in the range of about 30 to 80 mm.

14. A bag according to claim 1, wherein the shaped portion of the second seal is generally U- or V-shaped.

15. A bag according to claim 1, wherein the precut is a line of perforations that extends to close to the apex of the shaped portion of the second seal.

16. A bag according to claim 1, wherein the precut is a line of perforations that is inclined relative to said one of the first and second side edges from the bottom edge towards the centre of the bag.

17. A package comprising a bag according to claim 1 that contains at least one item in said area and has been closed and heat shrunk around the item(s) to closely conform to the at least one item in said area.

18. A package comprising a bag of a heat shrinkable, gas-barrier thermoplastic film and at least one item packaged in the bag, the bag comprising:

a) a bottom edge;

b) first and second side edges;

c) a closed top edge;

d) a first seal disposed adjacent the bottom edge and connecting the first and second side edges, said first seal defining a volume within the bag between it, the first and second side edges and the closed top edge in which the at least one item is received;

e) a second seal disposed substantially along the bottom edge or between the bottom edge and the first seal and connecting the first and second side edges, the second seal having a shaped portion adjacent a corner of the bag defined by one of the first and second side edges and the bottom edge which projects towards the closed top edge, said shaped portion having an apex closest to the closed top edge;

f) a precut formed in the thermoplastic film and extending from the bottom edge towards the apex of said shaped portion of the second seal;

wherein the first seal extends from the other of the first and second side edges across the bag towards said shaped portion of the second seal at a spacing from the bottom edge less than the spacing of said apex from the bottom edge and around said shaped portion of the second seal to said one of the first and second side edges, and wherein a manually graspable tab is formed in an area of the thermoplastic film delimited by the one of the first and second side edges, the first and second seals adjacent said one of the first and second side edges and said shaped portion of the second seal.

19. A package according to claim 18, wherein the bag has been heat shrunk around the at least one item to closely conform to the at least one item.

* * * * *